US007635172B2

(12) United States Patent
Ode

(10) Patent No.: US 7,635,172 B2
(45) Date of Patent: Dec. 22, 2009

(54) RECORDING APPARATUS AND METHOD FOR REARRANGING RECORDING DATA IN ACCORDANCE WITH RECORDING HEAD TILT

(75) Inventor: Takahiro Ode, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 535 days.

(21) Appl. No.: 11/533,047

(22) Filed: Sep. 19, 2006

(65) Prior Publication Data

US 2007/0076028 A1 Apr. 5, 2007

(30) Foreign Application Priority Data

Sep. 30, 2005 (JP) ..... 2005-287389

(51) Int. Cl.
*B41J 29/38* (2006.01)

(52) U.S. Cl. ..... 347/5; 347/9; 347/12

(58) Field of Classification Search ..... 347/5
See application file for complete search history.

(56) References Cited

U.S. PATENT DOCUMENTS 4,567,570 A * 1/1986 Peer ..... 358/1.8
6,609,845 B1 * 8/2003 Ninomiya ..... 400/124.08
6,793,312 B2 9/2004 Ohde
2005/0212903 A1 * 9/2005 Corbett et al. ..... 347/248
2006/0119678 A1 * 6/2006 Arakawa et al. ..... 347/9
2006/0203073 A1 * 9/2006 Ishizaka ..... 347/145
2006/0262152 A1 * 11/2006 Kuronuma ..... 347/14

* cited by examiner

*Primary Examiner*—Matthew Luu
*Assistant Examiner*—Shelby Fidler
(74) *Attorney, Agent, or Firm*—Canon U.S.A. Inc., I.P. Division

(57) ABSTRACT

A recording apparatus includes a generating unit for generating a window signal for setting the driving timing of the recording head for each nozzle array, a recording buffer in which the addresses are consecutively arranged corresponding to the conveying direction of the recording medium to store and read recording data, a first SRAM for storing data read from the recording buffer, a second SRAM for storing data read from the first SRAM according to tilt information associated with each respective block of nozzles, and a transfer unit configured to transfer data read from the second SRAM to a nozzle array.

9 Claims, 15 Drawing Sheets

Prior Art

Prior Art

Prior Art

Prior Art

DATA PROCESSING IS PERFORMED ASSUMING THAT WINDOW (3) IS OPENED ONE-COLUMN PORTION AFTER WINDOW (1), (2)

DATA PROCESSING IS PERFORMED ASSUMING THAT WINDOW (5) IS OPENED ONE-COLUMN PORTION AFTER WINDOW (3), (4)

DATA PROCESSING IS PERFORMED ASSUMING THAT WINDOW (7) IS OPENED ONE-COLUMN PORTION AFTER WINDOW (5), (6)

Prior Art

FIG.11

16 COLUMNS

256 NOZZLES

| | | a | b | c | d | e | f | g | h | i | j | k | l | m | n | o | p |
|---|---|---|---|---|---|---|---|---|---|---|---|---|---|---|---|---|---|
| 32 NOZZLES | 0 | a | b | c | d | e | f | g | h | i | j | k | l | m | n | o | p |
| 32 NOZZLES | 1 | a+1 | b+1 | c+1 | d+1 | e+1 | f+1 | g+1 | h+1 | i+1 | j+1 | k+1 | l+1 | m+1 | n+1 | o+1 | p+1 |
| 32 NOZZLES | 2 | a+2 | b+2 | c+2 | d+2 | e+2 | f+2 | g+2 | h+2 | i+2 | j+2 | k+2 | l+2 | m+2 | n+2 | o+2 | p+2 |
| 32 NOZZLES | 3 | a+3 | b+3 | c+3 | d+3 | e+3 | f+3 | g+3 | h+3 | i+3 | j+3 | k+3 | l+3 | m+3 | n+3 | o+3 | p+3 |
| 32 NOZZLES | 4 | a+4 | b+4 | c+4 | d+4 | e+4 | f+4 | g+4 | h+4 | i+4 | j+4 | k+4 | l+4 | m+4 | n+4 | o+4 | p+4 |
| 32 NOZZLES | 5 | a+5 | b+5 | c+5 | d+5 | e+5 | f+5 | g+5 | h+5 | i+5 | j+5 | k+5 | l+5 | m+5 | n+5 | o+5 | p+5 |
| 32 NOZZLES | 6 | a+6 | b+6 | c+6 | d+6 | e+6 | f+6 | g+6 | h+6 | i+6 | j+6 | k+6 | l+6 | m+6 | n+6 | o+6 | p+6 |
| 32 NOZZLES | 7 | a+7 | b+7 | c+7 | d+7 | e+7 | f+7 | g+7 | h+7 | i+7 | j+7 | k+7 | l+7 | m+7 | n+7 | o+7 | p+7 |

Prior Art

FIG.12

16 COLUMNS

| | | a | b | c | d | e | f | g | h | i | j | k | l | m | n | o | p | |
|---|---|---|---|---|---|---|---|---|---|---|---|---|---|---|---|---|---|---|
| 256 NOZZLES | 32 NOZZLES 0 | d | e | f | g | h | i | j | k | l | m | n | o | p | q | r | s | SEG0 … SEG31 |
| | 32 NOZZLES 1 | d+1 | e+1 | f+1 | g+1 | h+1 | i+1 | j+1 | k+1 | l+1 | m+1 | n+1 | o+1 | p+1 | q+1 | r+1 | s+1 | SEG32 … SEG63 |
| | 32 NOZZLES 2 | c+2 | d+2 | e+2 | f+2 | g+2 | h+2 | i+2 | j+2 | k+2 | l+2 | m+2 | n+2 | o+2 | p+2 | q+2 | r+2 | SEG64 … SEG95 |
| | 32 NOZZLES 3 | c+3 | d+3 | e+3 | f+3 | g+3 | h+3 | i+3 | j+3 | k+3 | l+3 | m+3 | n+3 | o+3 | p+3 | q+3 | r+3 | SEG127 |
| | 32 NOZZLES 4 | b+4 | c+4 | d+4 | e+4 | f+4 | g+4 | h+4 | i+4 | j+4 | k+4 | l+4 | m+4 | n+4 | o+4 | p+4 | q+4 | SEG128 … SEG159 |
| | 32 NOZZLES 5 | b+5 | c+5 | d+5 | e+5 | f+5 | g+5 | h+5 | i+5 | j+5 | k+5 | l+5 | m+5 | n+5 | o+5 | p+5 | q+5 | SEG160 … SEG191 |
| | 32 NOZZLES 6 | a+6 | b+6 | c+6 | d+6 | e+6 | f+6 | g+6 | h+6 | i+6 | j+6 | k+6 | l+6 | m+6 | n+6 | o+6 | p+6 | SEG192 … SEG223 |
| | 32 NOZZLES 7 | a+7 | b+7 | c+7 | d+7 | e+7 | f+7 | g+7 | h+7 | i+7 | j+7 | k+7 | l+7 | m+7 | n+7 | o+7 | p+7 | SEG224 … SEG255 |

SRAM(1) BANK 0

SRAM(1) BANK 0

SRAM(1) BANK 1

SRAM(2) BANK 0

SRAM(2) BANK 0

SRAM(2) BANK 0

SRAM(2) BANK 1

SRAM(2) BANK 1

RECORDING APPARATUS AND METHOD FOR REARRANGING RECORDING DATA IN ACCORDANCE WITH RECORDING HEAD TILT

BACKGROUND OF THE INVENTION

1. Field of the Invention

The present invention relates to a recording apparatus which uses a recording head and to the processing of recording data.

2. Description of the Related Art

In recent years, there has been a rapid implementation of multi-color and multi-nozzle technologies in ink jet printing apparatuses to obtain higher image quality and speed. Consequently, efforts have been made also with respect to the recording data so that a large amount of data can be transferred to the recording head at high speed.

FIG. 5 shows a control configuration of a recording data transfer for the purpose of transferring a large amount of data to the recording head at high speed. FIG. 6 shows a storing format of the recording data (refer to U.S. Pat. No. 6,793,312).

As shown in FIG. 5, the recording data stored in a recording buffer 105*a* is temporarily stored in a static random access memory (SRAM) (1) 106 in a 16-column unit. The recording data are generated by the various printing modes. The recording data are then transferred column by column to a recording head (constituted of 128 nozzles in FIG. 5).

The recording data transferred to the recording head 1 are controlled by a block driving order signal and a heater driving pulse signal provided separately, and are discharged as ink droplets.

The recording buffer 105*a* is provided on a synchronous dynamic random access memory (SDRAM) which has a burst reading function. As shown in FIG. 6(*i*), the recording data are stored in consecutive addresses in the direction of nozzle array (i.e., the y-direction in the figure). Hereinafter, such recording buffer configuration will be referred to as a raster-format recording buffer.

When the recording data is read from the recording buffer 105*a* by direct memory access (DMA), by designating a read start address A, the address is automatically incremented using the burst reading function of the SDRAM. That is, the data of eight-word portion are DMA read from address A, A+2, A+4, A+6, A+8, A+12, and A+14 at high speed in the direction of the nozzle array. This state is shown in FIG. 6(*ii*).

In addition, when the data are to be read in the direction of the next nozzle, the data of eight-word portion can be DMA read from consecutive addresses by setting the read start address at A+16. By repeating the DMA reading while updating the read start address of the recording buffer 105*a* for the entire recording head length (i.e., the entire nozzle number), 16 columns of data can be read out at once.

Furthermore, in the case where the read start address is updated in the scanning direction of the recording head 1 (i.e., in the x-direction in the figure), the read start address is changed to A+B and the reading is performed in the same manner. Here, "B" is a predetermined offset value. The read start address and the offset value are designated by setting a fixed value to a specific register. The register value of the read start address is updated sequentially.

The data of 16 columns that are read out, are stored in a SRAM (1) 106. Here, the data are converted in accordance with the format of the recording head 1 so that recording data can be read out column by column (from column (1) to column (16)), and are stored (refer to FIG. 6 (*iii*)).

In FIG. 6 (*iii*), the recording data of one column (column (1)) are read out from the address a, a+1, a+2, and a+3 of the SRAM (1) 106.

FIG. 8 shows a drive circuit for driving the recording head 1. The recording head is controlled by a serial-format recording data signal, a head clock signal, a latch signal for latching data, a block enable signal, and a heater driving pulse signal.

The block enable signal is a signal for each block configured by a plurality of recording head nozzles. The heater driving pulse signal controls driving of the discharging heater provided in the recording head.

In FIG. 8, the recording head drives the 256 heaters (recording elements) 806 dividing them into 16 blocks (one block consisting of 16 heaters), and 16 heaters are driven in each block. The recording data of one column read out from SRAM (1) 106 are rearranged for each block. Here, for example, block 0 is configured of SEG 0, SEG 16, . . . , SEG 240. Block 1 is configured of SEG 1, SEG 17, . . . , SEG 241. Blocks 2 to 15 are similarly configured. Thus, each block is configured of 16 bits.

The rearranged recording data are serially transferred to the recording head 1 by the head clock signal. The recording data received by a 16-bit shift register 801, are latched at the leading edge of the latch signal in latch 802. The block designation is indicated by four block enable signals, and the expanded heater 806 of the designated block is selected at the decoder 803.

Only the segment of the heater 806 designated by both the block enable signal and the recording data signal are driven by the actual heater driving pulse signal (AND gate 805), and the recording is conducted by discharged ink.

The block driving order is determined and controlled so as to minimize the variation in the landing position of the ink that arises from the variation of nozzles made in the manufacturing process.

In addition, in recent years, there is a means for reducing block enable signals by which block enable data converted to serial data is added to the serial signal of the recording data.

FIG. 9 illustrates the relation between the head clock signal and the recording data signal in the case where the recording data to which block data is added, is transferred.

In FIG. 9, the recording data are transferred to the recording head, at the leading edge and the trailing edge of the head clock signal. For example, in the case where the data of block 1 are transferred, the data of SEG 0 as data 0, the data of SEG 16 as data 1, . . . , and data of SEG 240 as data 15 are transferred in FIG. 9. The blocks are designated by 4 bits, BE0, BE1, BE2, and BE3, which follows the above data. For example, block 1 is selected by transferring data in the order of "1", "0", "0", "0".

In the case where the recording head is not correctly mounted on the carriage, or the ink discharging port is arranged so as to be tilted relative to the conveying direction of the recording medium, the recording position may become misaligned, and the desired recording result may not be obtained. In particular, the misalignment of the recording positions caused by tilting of the recording head may be more noticeable in color printing in which a plurality of colors are overlapped to form an image.

There is a case where the recording head is mounted on the carriage in a tilt (inclination) state due to incorrect mounting by a user. In addition, there is a case where a recording head is mounted whose nozzle array is previously tilted. In such a case, information about the tilt (inclination) of the nozzle array is obtained from the adjustment mode and the like, and the recording head is controlled based on the information.

Furthermore, there may be a case where correction required exceeds one column because a number of nozzles in the recording head is increased or the length of the nozzle array is extended.

In such a case, the nozzle arrays of the recording head are separated into blocks, for example, that of 32-nozzles, and a window signal is provided to each block. One recording head is regarded as a plurality of recording heads and the timing of the window signal is displaced. Thus, for each block, control is performed to correct the print timing in one-column trigger unit.

FIG. 10 shows a diagram to illustrate a control method for correcting a tilted recording head in one-column trigger unit. It should be noted that the degree of tilt is not limited to that as shown in FIG. 10. In FIG. 10, the recording head includes 256 nozzles and is set on the carriage so as to perform printing in a position displaced by one-column trigger of time in a unit of 64 nozzles.

In order to form a high-quality image, the tilt of such recording head is corrected such that window (1) to window (8) signals are provided in advance to each of the blocks (1) to (8), that include 32 nozzles respectively.

Since the recording head is tilted, if the window (1) to window (8) signals are opened (enabled) at the same timing, the data of block (3), for example, causes ink to be discharged earlier by one-column trigger as compared to the data of block (1).

Accordingly, the window (3) signal is opened one-column trigger (or one-column) later than the window (1) signal. The image made under such control looks as if it is formed by the ink discharged by a recording head with a nozzle array that is not tilted.

That is, one recording head is regarded as an assembly of a plurality of recording heads and each head is controlled independently so that the tilt of the recording head is corrected.

FIG. 11 shows a table illustrating the data reading position in the SRAM (1) 106 in the case where the control for correcting the tilt of the recording head shown in FIG. 10 is performed in the configuration shown in FIG. 5.

In FIG. 11, a to p on the horizontal axis and 0 to 7 on the vertical axis are indexes for indicating the addresses of the SRAM (1) 106. a0, a1, . . . , to a7 are arranged as consecutive addresses, and b0, b1, . . . , to b7, c0, c1, . . . , to c7, p0, p1, . . . to p7 are also arranged as consecutive addresses. These addresses correspond to the conveying direction of the recording medium, or in other words, to the direction perpendicular to the scanning direction of the recording head.

In addition, the values written in each box is the data stored in that address. That is, data a is stored in address a, data a+1 in address a+1, . . . , and data p+7 in address a+7.

In the case where the recording head (or the nozzle array) is tilted as in FIG. 10, when the recording data of one column are readout by accessing the consecutive addresses (such as a, a+1, a+2, a+3, a+4, a+5, a+6, and a+7) from SRAM (1) 106 in FIG. 5, the ink lands on the recording medium in accordance with the tilt of the recording head, and the dots become tilted.

Therefore, in order to prevent the dots from becoming tilted, the addresses are accessed in the order of d, d+1, c+2, c+3, b+4, b+5, a+6, and a+7 to read out data of one column.

However, in the configuration shown in FIG. 5, four triggers (or timings) are used in reading out data of one column stored in SRAM (1) 106 because each column position of the addresses d and d+1, addresses c+2 and c+3, addresses b+4 and b+5, and addresses a+6 and a+7 is different.

If the time between the triggers is T, the time for writing 16 columns of data is W, and the number of recording heads is N, for one bank as described before, the following relation should hold:

$$16T>NW \quad \text{(Equation 1)}$$

However, in the case where the data that are originally one column, are read over a plurality of column triggers in order to correct the tilt of the recording head, the equation 1 should be changed as follows if there is a tilt of three columns as in FIG. 10:

$$(16-3)T=13T>NW \quad \text{(Equation 2)}$$

According to this equation, in the case where the number of recording head N becomes large, or the number of nozzles in one array increases, that is, W becomes large, there will not be enough time for reading out the data which is transferred to the recording head.

In another words, in the configuration of FIG. 5, the data amount (or the number of columns) that can be transferred from SRAM (1) 106 to the recording head 1 with respect to one bank, corresponds to 16 columns if the tilt is zero. However, if the tilt is three columns, data of only 13 columns can be read out from one bank.

Therefore, in the configuration of FIG. 5, the data amount that can be read out from one bank decreases as the tilt increases. The step of transferring data from SRAM (1) 106 to the recording head 1 becomes a bottleneck in the process of transferring data from the recording buffer 105*a* to the recording head 1.

In addition, in the case where the timing of storing into SRAM (1) 106 is set independently in response to the tilt of the recording head 1, the address management of the reading address in the recording buffer 105*a* and the like are also conducted independently so that relevant control becomes cumbersome. Alternatively, in the case where the timing of reading out from SRAM (1) 106 is set independently in response to the tilt of the recording head 1, the control becomes cumbersome also.

SUMMARY OF THE INVENTION

At least one embodiment of the present invention is directed to solving or at least mitigating the problems discussed above. At least one embodiment of the invention provides a recording apparatus and a method for controlling such recording apparatus to achieve efficient memory access and data transfer.

According to an aspect of the present invention, at least one embodiment is directed to a recording apparatus which records on a recording medium using a recording head having a plurality of recording element arrays in a main scanning direction. Each of the recording element arrays includes a plurality of recording elements in a direction of a tilt relative to a conveying direction of the recording medium in a plurality of blocks. The recording apparatus includes an input unit configured to receive recording data from an outside source, an obtaining unit configured to obtain tilt correction information associated with each block, and a generating unit configured to generate a permission signal permitting drive of a plurality of recording elements for each block based on the correction information. The recording apparatus also includes a first memory unit having a buffer that can store the recording data received by the input unit. The first memory unit is capable of storing a recording data amount of at least one scanning of the recording head. Further included in the recording apparatus are a second memory unit having a plurality of buffers that store data of m columns read from the first memory unit, a third memory unit having a plurality of buffers that store data of m columns read from the second memory unit, a first storage unit configured to read data in m-column unit from the first memory unit by one-time DMA transfer and store the data in one of the buffers of the second memory unit, a reading unit configured to read one column of data from the second memory unit in each block based on a pointer corresponding to each block and the correction information, a second storage unit configured to store the data of one column read by the reading unit in the same column position of the third memory unit, a control unit configured to repeatedly execute the reading of the column of data by the reading unit and the storing of the data in the third memory unit by the second storing unit by m columns, while updating each column position read by the reading unit and the column position for storing by the second storage unit, a transfer unit configured to read the data of one column from the third memory unit and transfer the data to the recording head, and a driving unit configured to drive the recording element in a unit of block, based on the permission signal generated by the generating unit.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 11 shows a table illustrating a reading position of data from the SRAM (1) at the time when the recording head is controlled and corrected as shown in FIG. 10.

FIG. 12 shows a table illustrating a storage state of SRAM (2) according to an embodiment of the present invention.

DETAILED DESCRIPTION OF THE EMBODIMENTS

Embodiments of the invention will be described in detail below with reference to the drawings.

Figure 3:
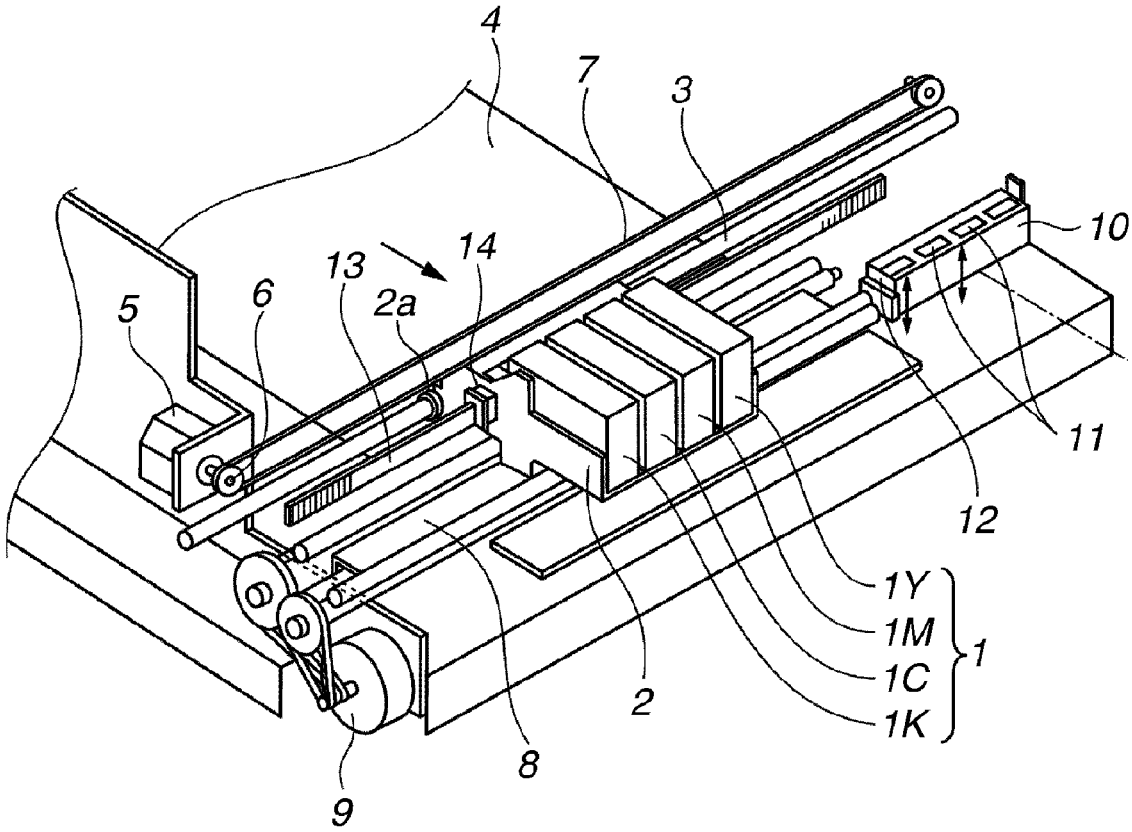
FIG. 3 shows an exemplary configuration of a recording apparatus to which embodiments of the present invention can be applied.

FIG. 3 shows an exemplary configuration of a recording apparatus to which embodiments of the present invention can be applied. The recording apparatus in an embodiment is an ink jet recording apparatus having a recording head 1 according to an ink jet recording method.

The recording head 1 uses an electrothermal converting element such as a discharge heater having a heat element as the energy generating unit to heat the ink, and an ink droplet is discharged by the heat energy.

The recording head 1 includes four color heads, that is, cyan recording head 1C, magenta recording head 1M, yellow recording head 1Y, and black recording head 1K. Each recording head 1C, 1M, 1Y, and 1K is mounted on the carriage 2 and lined in a length direction of a guide shaft 3. In other words, each recording head is mounted on the carriage 2 disposed in a line in a traveling direction (scanning direction) of the carriage 2. When the recording head 1 is mounted on the carriage 2, the nozzle array of each color forms a specified angle with the conveying direction of the recording medium.

In FIG. 3, the recording head 1 is mounted on the carriage 2 in such a posture that ink droplets can be discharged downward. Ink droplets are discharged while a bearing 2*a* of the carriage 2 moves along a guide shaft 3, and an image is formed by scanning on a recording medium 4 such as a recording sheet.

The carriage 2 moves back and forth along the guide shaft 3 driven by the rotation of a pulley 6 to which the driving force of the carriage motor 5 is transmitted through a timing belt 7.

When the recording head 1 completes recording of one scanning, the recording head 1 stops recording and the carrier motor 9 is driven. The carrier motor 9 conveys the recording medium 4 placed on the platen 8, by a specific amount in a direction orthogonal to a traveling direction of the carriage 2. Then, the image formation of next one scanning is performed, while the carriage 2 moves again along the guide shaft 3. These operations are repeated until the formation of images on the recording medium 4 is completed.

A recovery unit 10 is arranged on the right side of the recording apparatus. The recovery unit 10 maintains ink discharge from the recording head 1 in good condition. The recovery unit 10 is provided with a cap 11 for capping the recording head 1; a wiper 12 for wiping the discharge surface of the recording head 1; and a suction pump (not shown) for sucking ink from the ink discharge nozzles of the recording head 1.

In addition, the recording apparatus of the present embodiment is provided with an encoder scale 13 and an encoder 14 which detects the traveling speed of the carriage 2, and carries out feedback control when the carriage motor 5 is driven. Furthermore, the encoder 14 reads the positional information of the encoder scale 13 in order to provide discharge timing (hereinafter referred to as heat timing) of the recording head 1. A trigger signal (TRG) is generated based on the signal from the encoder 14 and is used in the data transfer process.

Figure 4:
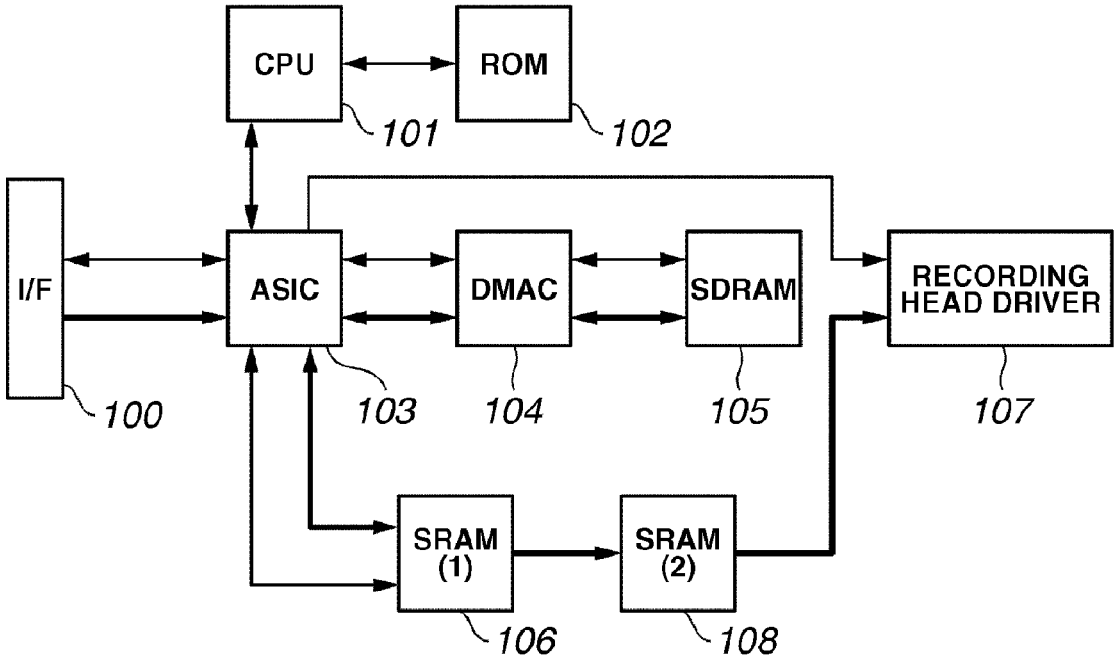
FIG. 4 shows internal components of a recording apparatus according to an embodiment of the present invention.
Figure 5:
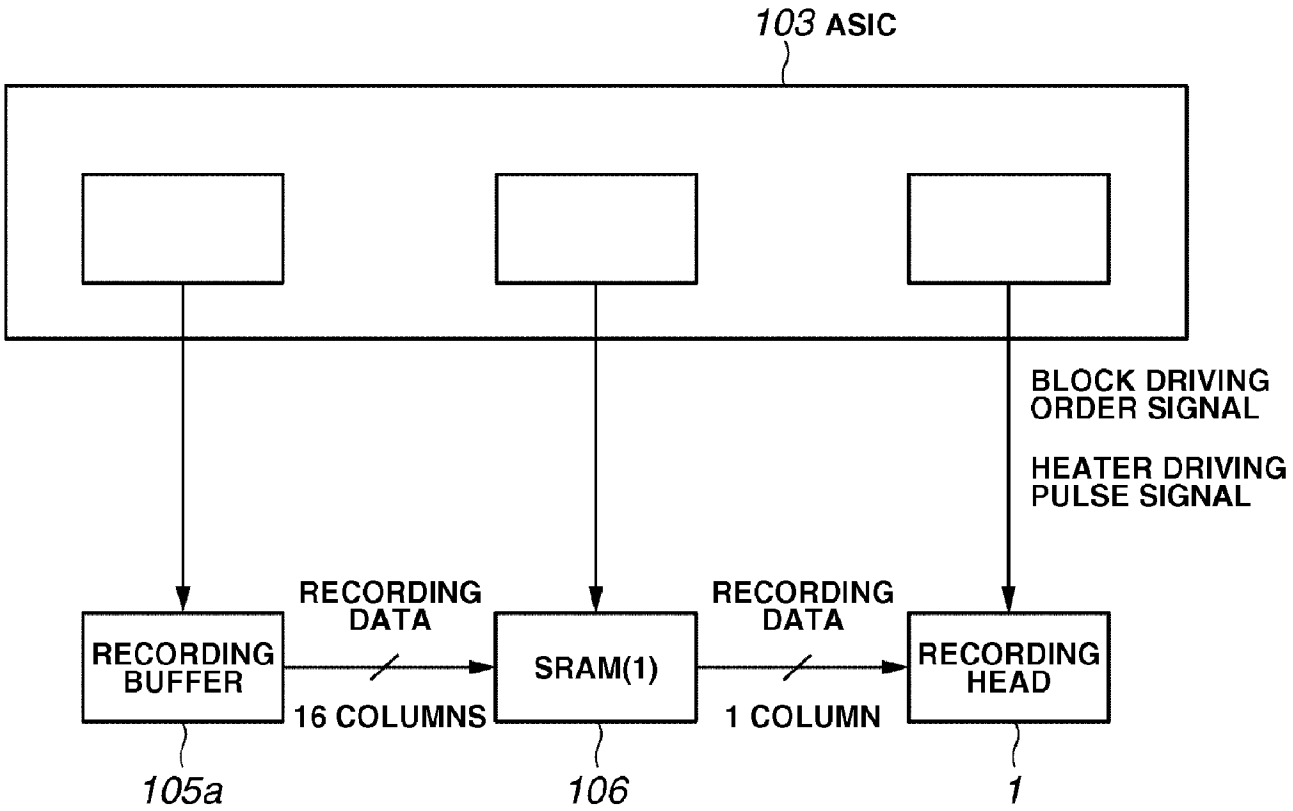
FIG. 5 shows a control configuration of a recording data transfer in a conventional recording apparatus.
Figure 6:
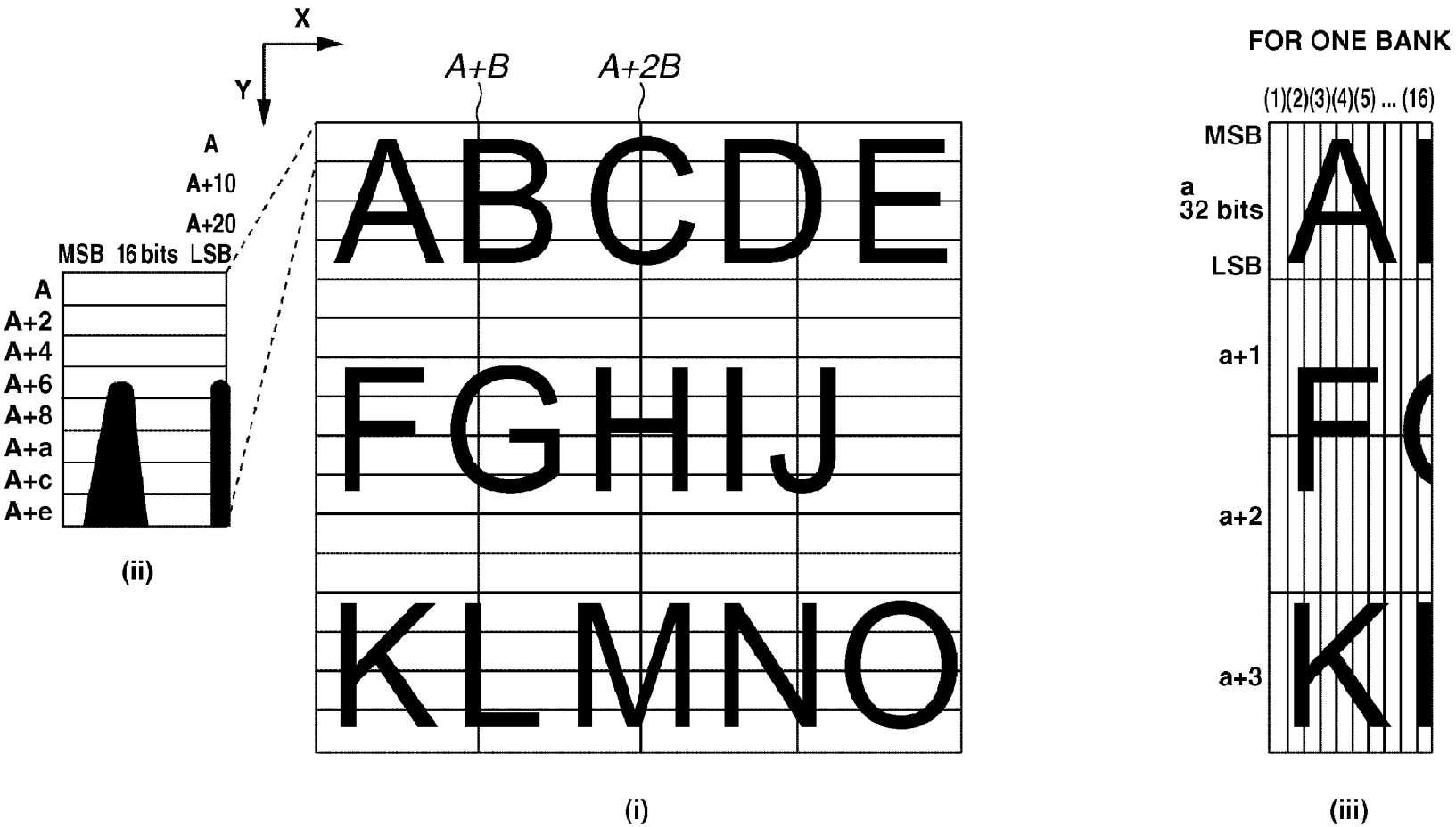
FIG. 6 shows a storing format of recording data in a conventional recording apparatus.

FIG. 4 shows internal components of a recording apparatus according to an embodiment of the present invention. The thin arrow indicates the control signal and the thick arrow indicates the data flow. The interface (I/F) block 100, which is formed of FIFO memory, sends and receives recording data to and from the recording apparatus and the host computer connected to the apparatus.

When the data including the recording data is received, the data are provisionally stored. The application specific integrated circuit (ASIC) 103 then analyzes and acquires the control code from among the stored data, and a DMA controller (DMAC) is used to store the recording data extracted from among the whole data, in the recording buffer provided in the SDRAM 105. This process is performed with respect to the data corresponding to each color.

A CPU 101 performs various controls such as recording operation. A ROM 102 stores programs such as the procedure of recording operation. An ASIC 103 controls the entire system under the management of the CPU 101. The ASIC 103 controls the recording data analysis described above, DMA reading of the recording data from the recording buffer which will be described later, conversion of recording data to a format suitable for the nozzle arrangement of the recording head 1, and transfer of the recording data to the recording head 1.

The DMAC 104 controls the plurality of DMA channels used in the present recording apparatus. For example, in the case where a DMA demand overlaps with each other, an arbitration control is performed by a predetermined order of priority.

The SDRAM 105 temporarily stores the data and includes a recording buffer. In the present embodiment, SDRAM is used as a RAM (memory unit), and data of eight words can be read from consecutive addresses by one-time DMA reading (DMA reading process). The data of eight words is read by the burst reading function.

The SRAM (1) 106 stores the recording data that are DMA read from the recording buffer in the SDRAM 105, after the data is converted to a format suitable for the recording head 1. To be more precise, the data read out from the recording buffer are HV converted, and the converted data are stored in the SRAM (1) 106.

The SRAM (2) 108 stores the recording data stored in the SRAM (1) 106, after the data are rearranged in accordance with the tilt of the recording head 1 in units of columns to correct the tilt of the recording head 1.

The recording head driver 107 controls the recording head 1 which carries out the ink jet printing. The driving timing of the recording head driver 107 is generated based on the information from the encoder 14 described earlier, and is controlled by the ASIC 103.

Figure 1:
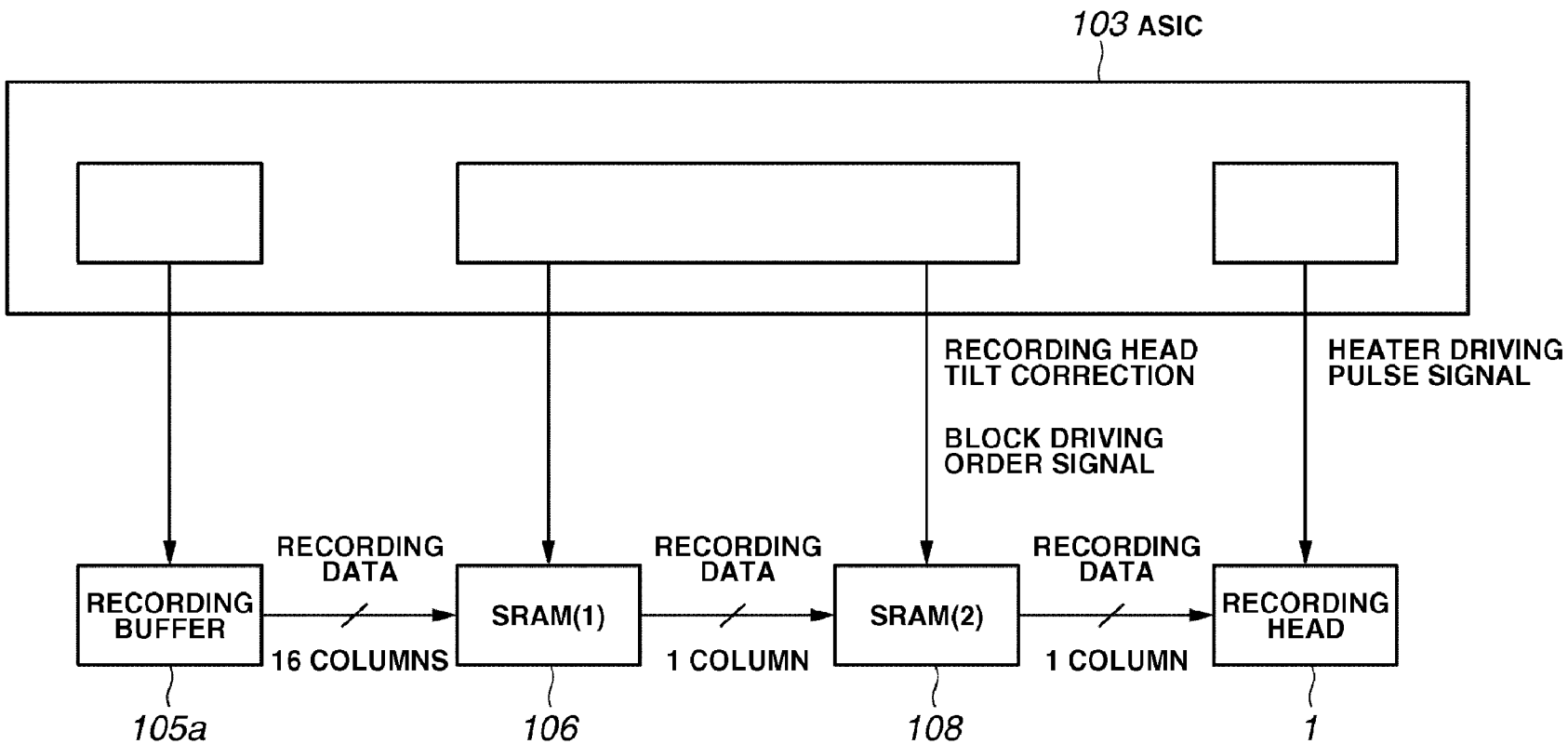
FIG. 1 shows a control configuration of a recording data transfer according to an embodiment of the present invention.

FIG. 1 shows a control configuration of recording data transfer according to an embodiment of the present invention. As shown in FIG. 1, in addition to SRAM (1) 106, SRAM (2) 108 is further provided between SRAM (1) 106 and the recording head 1 within the system that is configured to transfer the recording data from the recording buffer 105*a* to the recording head 1. In the conventional data processing system, only SRAM (1) 106 in FIG. 11 is provided.

In addition, the block driving order signal supplied from the ASIC 103 to the recording head 1 is outputted also to the newly provided SRAM (2) 108. Furthermore, the ASIC 103 outputs to the SRAM (1) 106 a correction value (recording head tilt correction signal and nozzle array tilt correction signal) which corrects the tilt of the recording head 1. The correction value shows the tilting state of the recording element alignment as data generated for each block.

The correction value is a signal which indicates the column position where the recording data is read out from the SRAM (1) 106 as shown in FIG. 11. The signal is outputted independently with respect to each block.

As shown in FIG. 1, the ASIC 103 outputs the recording data read out signal to the recording buffer 105*a*, and outputs the recording data storage signal to SRAM (1) 106. In addition, the ASIC 103 outputs recording data read out signal to the SRAM (1) 106 and a recording data storage signal to the SRAM (2) 108. These data transfer processes are described with respect to one nozzle array (recording element array). Therefore, in the case where the recording head 1 has four nozzle arrays, the respective process is performed independently for each nozzle array.

<The Process Flow for Accessing SRAM (1) and SRAM (2)>

Figure 2:
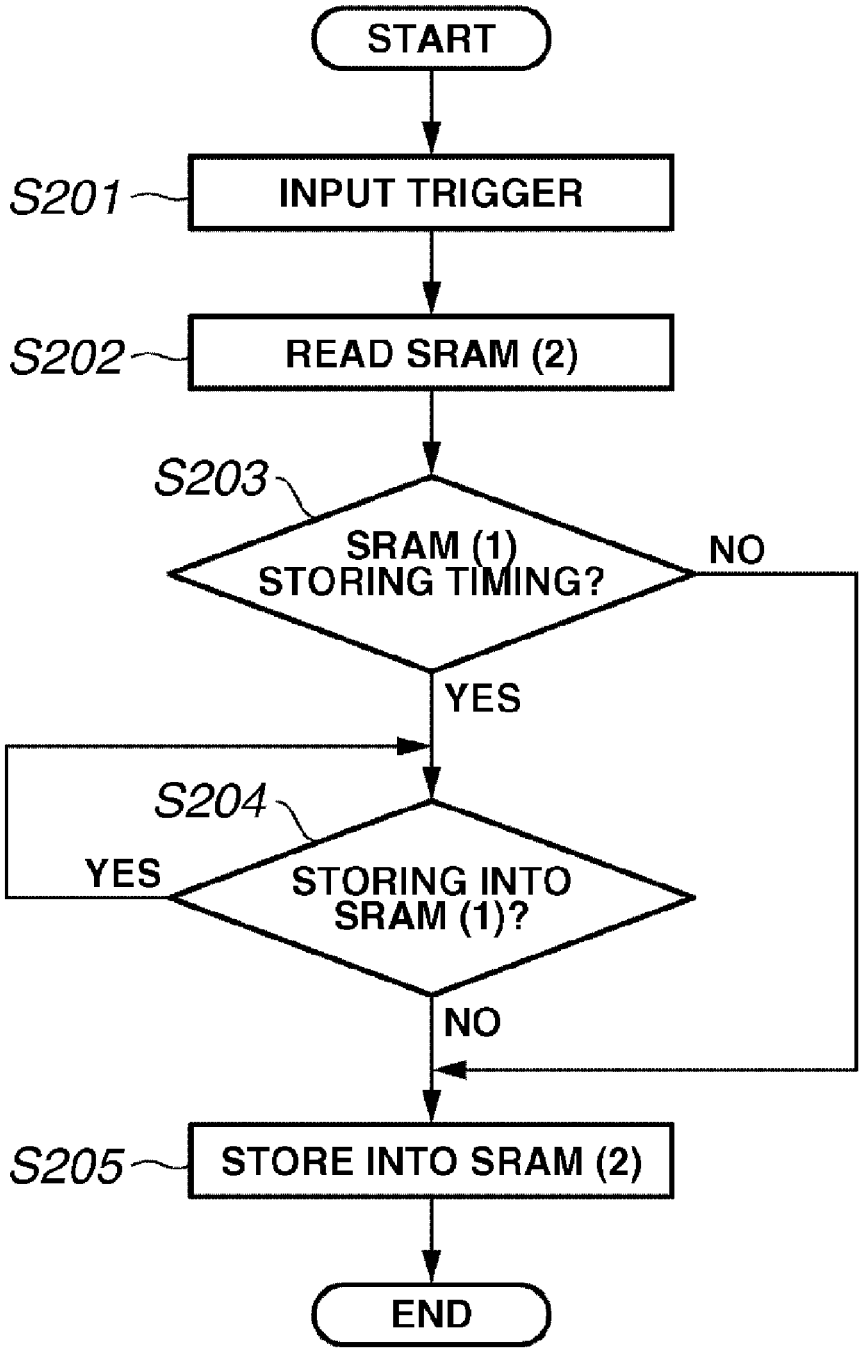
FIG. 2 shows a flowchart illustrating a control sequence for accessing the SRAM (1) and SRAM (2) in FIG. 1 according to an embodiment of the present invention.

FIG. 2 is a flowchart illustrating a control sequence for accessing SRAM (1) 106 and SRAM (2) 108 in FIG. 1 according to an embodiment of the present invention. This process is executed every time a trigger (TRG) signal (refer to FIG. 7) is generated.

When a trigger signal is inputted in step S201, data of one column of the recording head 1 are read out from the SRAM (2) 108 and is transferred to the recording head 1 in step S202. In step S203, it is determined whether the trigger timing matches the storing timing of the SRAM (1) 106.

As described above, since the timing of storing from the recording buffer 105*a* into SRAM (1) 106 is set by every 16 triggers, it should be determined whether the present trigger matches that timing.

If it is determined that the trigger indicates the timing for storing into SRAM (1) 106 in step S203, the storing into SRAM (1) 106 is performed in step S204.

After the storing is completed (or in the case where the determination is NO in step S204), recording data of one column stored in SRAM (1) 106 are read out and is stored in SRAM (2) 108 in step S205.

Step S205 is executed even in the case where the determination is No in step S203.

In other words, the control shown in FIG. 2 places the first priority on the reading out from SRAM (2) 108. If, as a result of checking, it is determined that the timing is that of storing into SRAM (1) 106, the storing from the recording buffer 105*a* to SRAM (1) 106 is performed by a DMA transfer process.

The timing of storing into the SRAM (1) 106 is determined, for example, depending on whether data of 16 columns are read out from the SRAM (1) 106. The determination is made, for example, by ASIC 103. The second priority is placed on the storing process into the SRAM (1) 106. The third priority is placed on the transfer process from the SRAM (1) 105 to the SRAM (2) 108.

Figure 7:
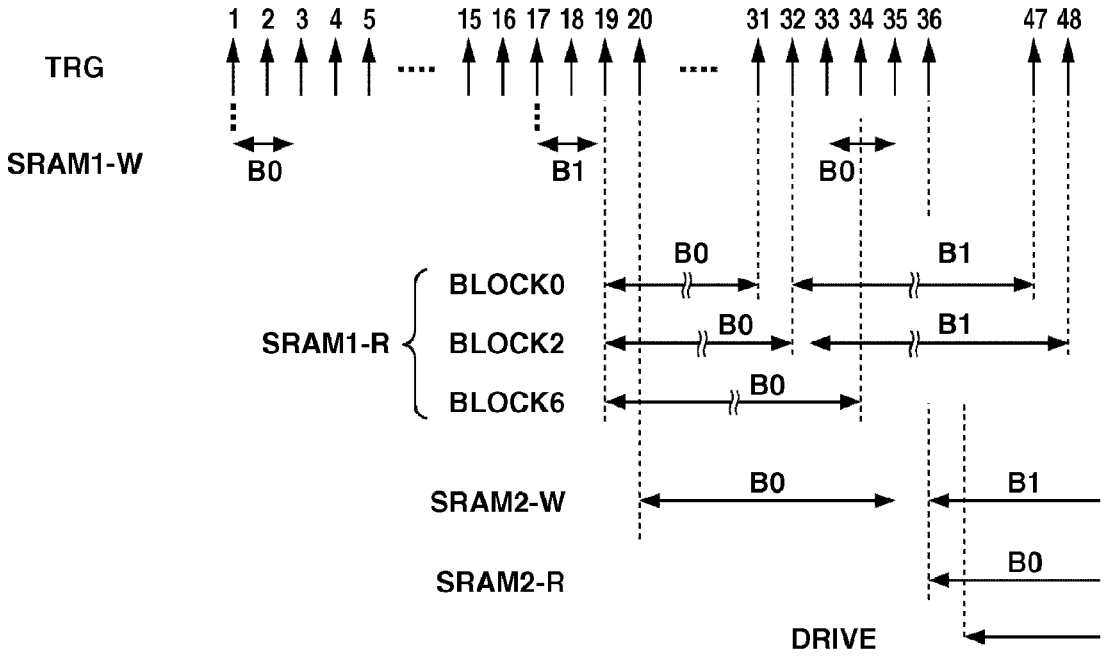
FIG. 7 shows a diagram illustrating storing timing and reading timing of SRAM (1) and SRAM (2) according to an embodiment of the present invention.
Figure 8:
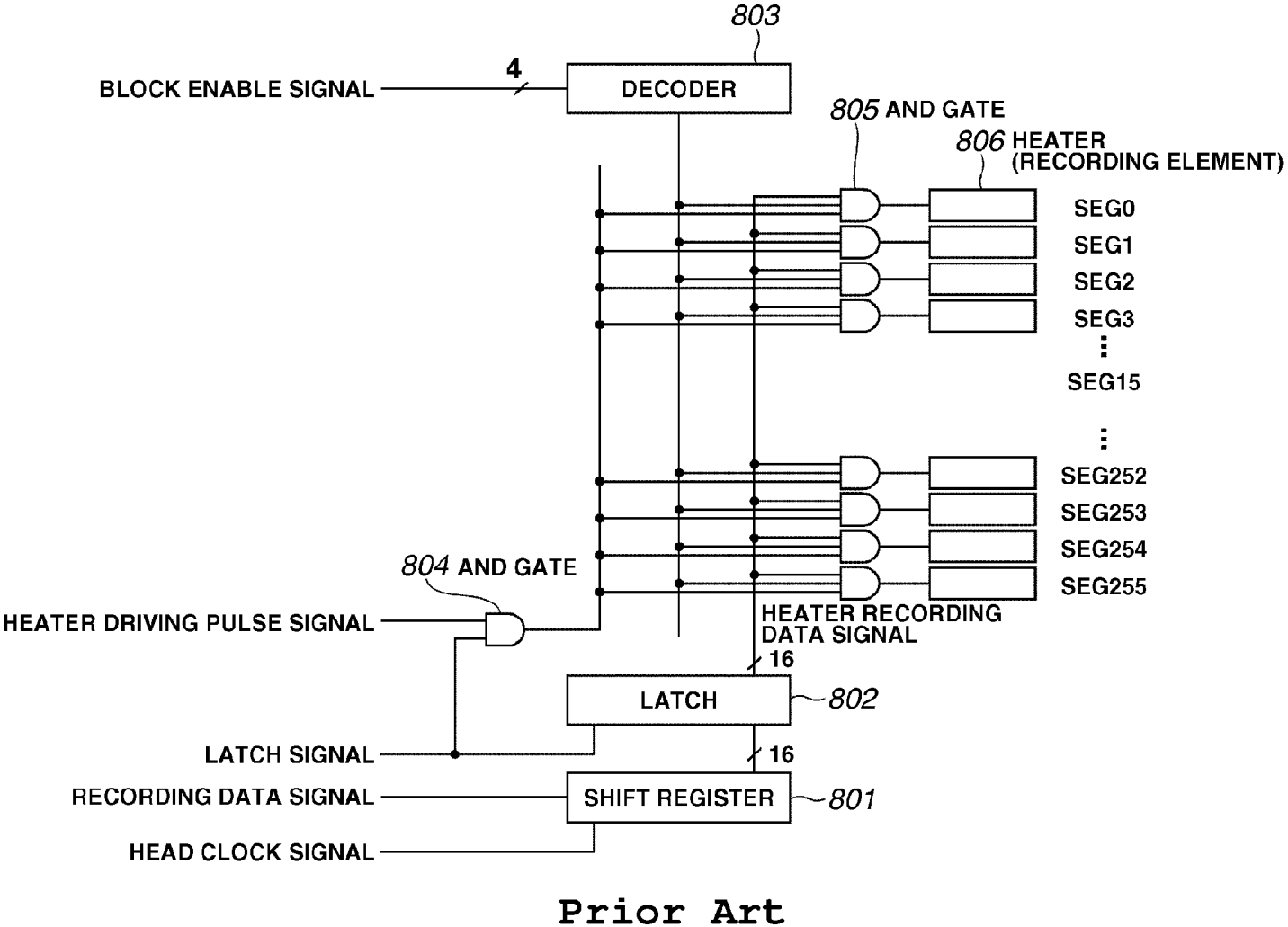
FIG. 8 shows a drive circuit which drives a recording head.
Figure 9:
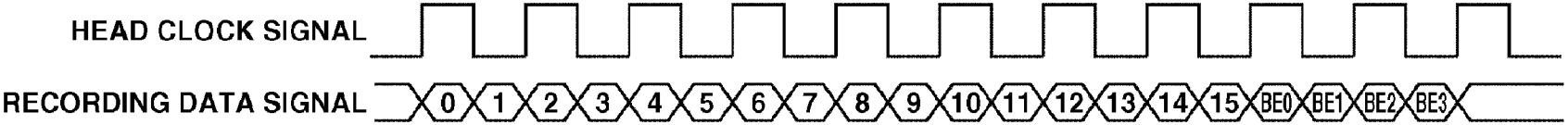
FIG. 9 shows the relation between a head clock signal and a recording data signal in the case where the recording data are transferred with block data attached to them.
Figure 10:
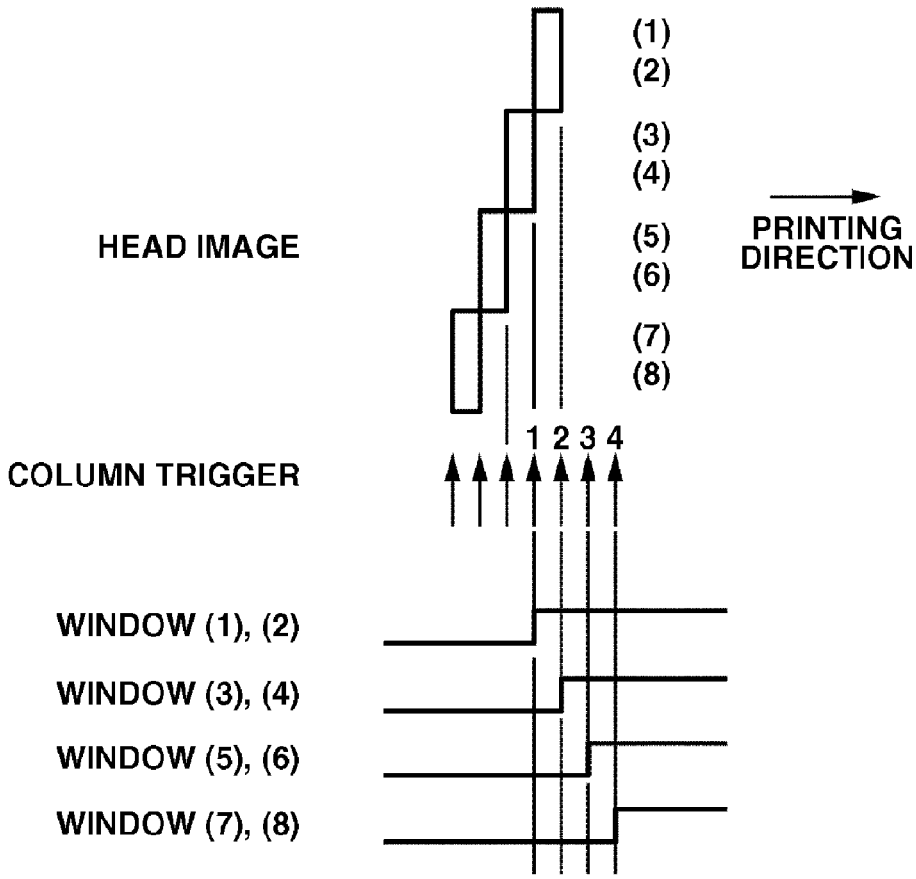
FIG. 10 shows a diagram illustrating a control method for correcting a recording head which is tilted.

The SRAM (1) 106 has an area of two pages (bank 0 and bank 1) for storing data of 16 columns. In addition, the SRAM (2) 108 has an area of two pages (bank 0 and bank 1) for storing data of 16 columns. As shown in FIG. 7, control is performed such that data are stored in one bank of the two pages (or two areas) of SRAM (2) 108 while data are transferred sequentially from another bank to the recording head.

Also in SRAM (1) 106 a, control is performed such that while data are transferred from one of the banks to the SRAM (2) 108, data are stored in another bank.

In this description, it is assumed that memory units (SRAM (1) 106 and SRAM (2) 108) are provided respectively to one recording head (or one nozzle array). The memory units are provided independently for each color.

<Timing of Accessing SRAM>

FIG. 7 shows the data storing timing and reading timing of SRAM (1) 106 and of SRAM (2) 108 with respect to the data corresponding to one nozzle array.

SRAM 1-W indicates the process of storing into SRAM (1) 106, and SRAM 1-R indicates the process of reading out from SRAM (1) 106. SRAM 2-W indicates the process of storing into SRAM (2) 108 and SRAM 2-R indicates the process of reading out from SRAM (2) 108.

Such memory accessing are conducted synchronously with the TRG signal. The DMA unit performs the storing in the SRAM (1) and transfers data of 16 columns in an interval of two triggers (for example). As shown in FIG. 7, the storing is conducted in bank 0 (B0) and bank 1 (B1) alternately in a 16-column cycle.

The reading of SRAM (1) is described below. BLOCK 0 indicates a period of time for reading data corresponding to block 0. BLOCK 2 indicates a period of time for reading data corresponding to block 2. BLOCK 6 indicates a period of time for reading data corresponding to block 6. As shown in FIG. 7, the reading out from bank 0 is conducted when the storing in bank 1 of SRAM (1) 106 is completed.

The length of time for reading out data is different for each block because a reading start position is different in each block. The difference depends on the correction value described above.

The reading of SRAM (1) will be described by referring to block 0 as an example. The reading of bank 0 starts at TRG 19. This reading is conducted during the period B0 indicated by the arrow. One column is read per one trigger. Since this period is equal to 13 trigger, 13 columns are read out. The reading of bank 1 is conducted at the next TRG signal. After that, bank 0 and bank 1 are read alternately. The other blocks are read in the same manner.

In other words, at TRG 32, for example, the data of block 0 is read from bank 1 while the data of block 2 is read from bank 0.

The storing in SRAM (2) 108 will be described next. The start timing for storing in SRAM (2) 108 is one trigger after the start timing of reading out from SRAM (1) 106. For example, the start timing of storing in SRAM (2) 108 is TRG 20, and the reading start timing of SRAM (1) 106 is TRG 19. The storing of 16 columns in SRAM (2) 108 is conducted in a period of time corresponding to the 16 triggers as shown in FIG. 7. One column is stored also per one trigger in the storing process into SRAM (2) 108.

The reading out from SRAM (2) 108 will be described. The reading out from SRAM (2) 108 is started after storing the data into one of the banks of SRAM (2) 108. The start timing is the same as the start timing of SRAM (2) 108.

For example, the start timing of storing as well as the reading into and from SRAM (2) 108 is TRG 36.

It should be noted that the start timing of the recording head 1 driving is one trigger after the reading start timing of SRAM (2) 108.

<The Storage State of the SRAM (2)>

FIG. 12 illustrates the storage state of the SRAM (2) 108 according to an embodiment of the present invention. Addresses a, b, c, d, etc. are allocated in the scanning direction of the recording head. In addition, consecutive addresses a+1, a+2, etc. are allocated in the conveying direction of the recording medium. 32 bits of data are stored per one address in SRAM (2) 108 as well as SRAM (1) 106.

FIG. 12 shows the correspondence between the address and the recording element of the recording head. For example, data stored in addresses a, b, . . . , and p correspond to SEGO to SEG31, and data stored in addresses a+1, b+1, . . . , and p+1 correspond to SEG32 to SEG63. In other words, 1 bit of data corresponds to 1 SEG.

The addresses are expressed in the same way (a, a+1, . . . , p+6, p+7) both in FIG. 11 and FIG. 12 for ease of description. However, the actual addresses are allocated uniquely, and separate areas are provided in each case.

As shown in FIG. 12, the recording data in SRAM (2) 108 are rearranged and stored so as to correct the tilt of the recording head and to have consecutive addresses.

That is, the data d, d+1, c+2, c+3, b+4, b+5, a+6, a+7 are stored in this order in the addresses a to a+7.

<The Storing Process Of Data Read Out From the Recording Buffer, into SRAM (1)>

Figure 13:
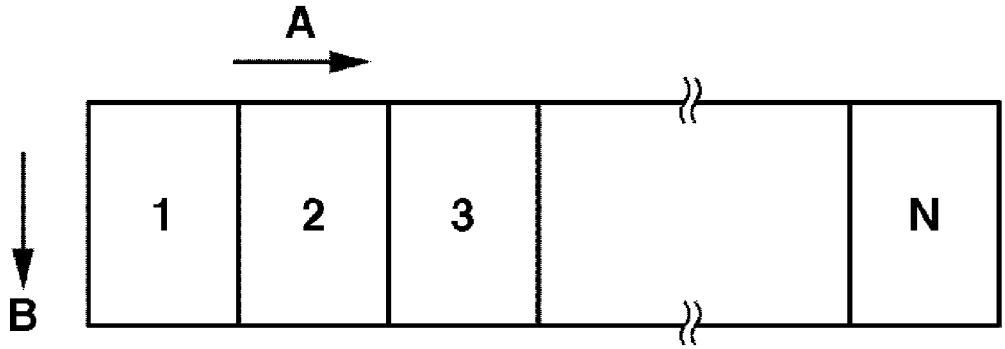
FIG. 13 shows a diagram illustrating relation between a scanning direction A of a recording head and a nozzle array direction B in a recording buffer.

FIG. 13 shows the relation between the scanning direction A of the recording head and the nozzle array direction B in the recording buffer 105*a*.

The recording buffer 105*a* has an area for retaining data amount of at least one-band (data amount used for one scanning of the recording head). As shown in FIG. 13, the area for storing data of one-band is divided into N data blocks. The DMA transfer unit reads each data block, and the stored data block is sequentially stored into SRAM (1) 106. An HV conversion is conducted when storing the data into SRAM (1) 106.

A size of one data block corresponds to data of 16 columns. When recording is started by one scanning, the data block 1 is stored in bank 0 of SRAM (1) 106. The next data block 2 is then read out from the recording buffer 105*a* and is stored in bank 1 of SRAM (1) 106. After reading of bank 0 is completed, the next data block 3 is stored in bank 0 of SRAM (1) 106. In this manner, the ASIC 103 conducts alternate storing in the two banks of SRAM (1) 106.

<Reading of SRAM (1) Using a Pointer>

The ASIC 103 has a unit for controlling the reading in SRAM (1) 106. This reading control unit has a pointer corresponding to each block and independent of each other. Since there area eight blocks, eight pointers are provided.

These pointers can designate the column position over a plurality of banks. For example, the pointer corresponding to block 0 is referred to as pointer 0. In the same way, pointer 1 corresponds to block 1, and pointer 2 corresponds to block 2. In such a way, the reading process is conducted by 8 pointers.

The case will be described where a correction value (value related to the tilt) of block 0 and block 1 is 3, a value of block 2 and block 3 is 2, a value of block 4 and block 5 is 1, and a value of block 6 and block 7 is 0. As shown in FIG. 11, the pointer 0 and pointer 1 indicate column position d, and the pointer 2 and pointer 3 indicate column position c. Here, all pointers are assumed to be designating bank 0.

The data are then read from each block in accordance with the pointer. For example, data of block 0 are read out from address d, and data of block 7 are read out from address a+7.

After conducting the reading, the pointer is moved one column forward for one column position. That is, the pointer 0 indicates column position e, and pointer 7 indicates column position b. In this way, as the reading control unit conducts the reading, each pointer moves the position it is indicating, one column position forward. As can be seen in FIG. 11, reading is conducted from one bank.

In addition, for example, after designating column p and conducting the reading, the pointer 0 designates column a of bank 1 instead of column a of bank 0. At this time, the pointer 2 and pointer 3 designate the column position p of bank 0.

As described, the pointer is controlled by the reading control unit to designate the head column position of bank 1 subsequent to the final column position of bank 0 (or column position p in this case).

In this manner, the pointer sequentially designates the column over two banks.

As described above, the reading process of SRAM (1) 106 has a mode for reading out from one bank and a mode for reading out from both banks.

<Storing Process into SRAM (2)>

The process performed for SRAM (2) 108 to obtain a storage state as shown in FIG. 12 will be described.

As shown in the shaded area in FIG. 11, the data are read out from SRAM (1) 106 according to the independent correction value of each block as described above. That is, the data of one column are read out from the addresses d, d+1, c+2, c+3, b+4, b+5, a+6, and a+7 of bank 0 in SRAM (1) 106.

The data of one column that are read out, are then stored in the addresses a, a+1, . . . , and a+7 of bank 0 in SRAM (2) 108.

The block to which the data is stored, corresponds to the block from which the data is read out. That is, the data read out from block 0 of SRAM (1) 106 is also stored in block 0 of SRAM (2) 108. Similarly, the data read out from block 3 of SRAM (1) 106 is also stored in block 3 of SRAM (2) 108.

The order of storing is, for example, the data of block 0 are stored first, then the data of block 1, and lastly the data of block 7. The storing in SRAM (2) 108 is controlled in the above order.

Returning to the reading process, the data of the next one column are read out from the addresses e, e+1, d+2, d+3, c+4, c+5, b+6, and b+7 in bank 0 of SRAM (1) 106 and are then stored in the addresses b, b+1, . . . , and b+7 in bank 0 of SRAM (2) 108. Subsequently, reading is conducted in the same way.

The data are then read out from the addresses p, p+1, o+2, o+3, n+4, n+5, m+6, and m+7 of bank 0 in SRAM (1) 106, and are stored in the addresses m, m+1, . . . and m+7 of bank 0 in SRAM (2) 108. Thus far, the data are read out from one bank and stored into one bank.

Figure 14A:
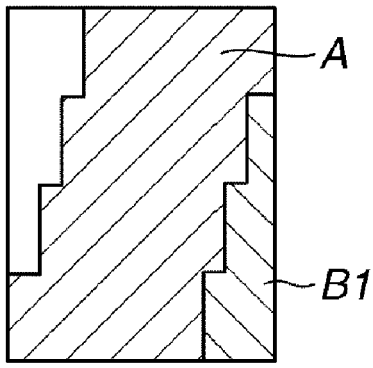
FIGS. 14A, 14B, and 14C show diagrams illustrating portions of the SRAM (1) from which data are read according to an embodiment of the present invention.
Figure 15A:
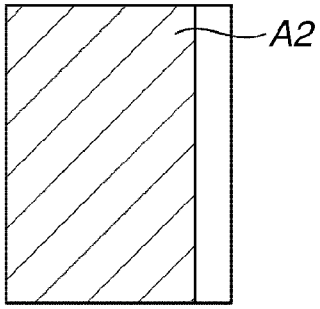
FIGS. 15A, 15B, 15C, 15D, and 15E show diagrams illustrating portions of the SRAM (2) into which data are stored according to an embodiment of the present invention.

FIG. 14A shows bank 0 of SRAM (1) 106, and an area A is the area that is read out in the above description. FIG. 15A shows bank 0 of SRAM (2) 108, and an area A2 is the area where the data is stored in the above description. A state is shown in which data of 13 columns, from column position a to column position m, are stored.

Next, the data are read out from the two banks of SRAM (1) 106 and stored into one bank of SRAM (2) 108. That is, the data of one column are read out over the two banks of SRAM (1) 106.

Figure 14C:
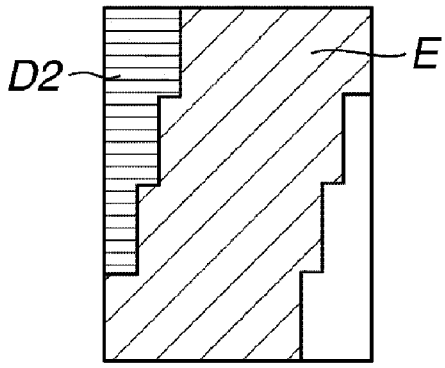
Figure 14B:
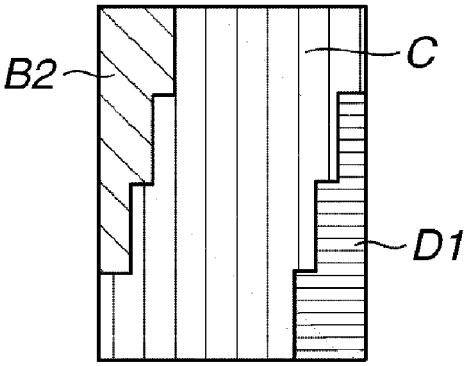

FIG. 14B describes bank 1 of SRAM (1) 106. Data are read out from area B1 in FIG. 14A and from area B2 in FIG. 14B, and are stored in area A3 of bank 0 in SRAM (2) 108 shown in FIG. 15B.

To be more precise, in SRAM (1) 106, the data are read out from addresses a, a+1 (which are included in area B2) of bank 1, and from addresses p+2, p+3, o+4, o+5, n+6, and n+7 (which are included in B1) of bank 0. The data are then stored sequentially in addresses n, n+1, . . . , and n+7 in bank 0 of SRAM (2) 108.

The data are stored in bank 0 of SRAM (2) 108 in the order of block 0, block 1, and block 2. The data corresponding to block 7 are stored last.

As for the data of remaining 2 columns, the data of one column are read out from the two banks of SRAM (1) 106 and written in bank 0 of SRAM (2) 108 in the same manner.

That is, the data are read out from addresses b, b+1, a+2, a+3 of bank 1 in SRAM (1) 106 and addresses p+4, p+5, o+6, and o+7 in bank 0 of SRAM (1) 106, and are stored sequentially in addresses o, o+1, . . . , and o+7 of bank 0 in SRAM (2) 108.

In addition, the data are read from the addresses c, c+1, b+2, b+3, a+4, and a+5 of bank 1 in SRAM (1) 106 and addresses p+6 and p+7 of bank 0 in SRAM (1) 106, and are stored sequentially in addresses p, p+1, . . . , and p+7 of bank 0 in SRAM (2) 108.

Figure 15B:
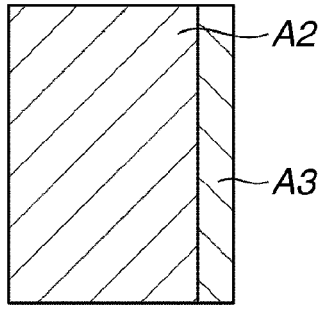

By performing the above processes, the data can be stored in an area A3 (3-column portion) in FIG. 15B, and the storing of data of 16 columns in bank 0 of SRAM (2) 108 is completed. A state after the storing process is completed, is shown in FIG. 15B.

Next, the data of 16 columns are stored in bank 1 in SRAM (2) 108. Also in this case, the process is performed similar to that performed to bank 0. That is, data of 13 columns of an area C in FIG. 14B are stored in an area C2 in FIG. 15C. The data are then read out from an area D1 of bank 1 in SRAM (1) 106 shown in FIG. 14B and an area D2 of bank 0 in SRAM (1) 106 shown in FIG. 14C, and are stored in an area C3 of bank 1 in SRAM (2) 108 shown in FIG. 15D.

Figure 15E:
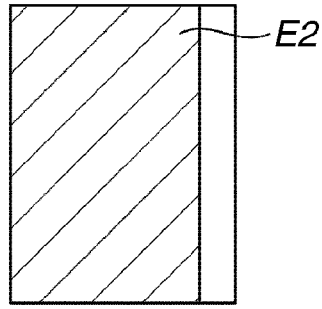
Figure 15C:
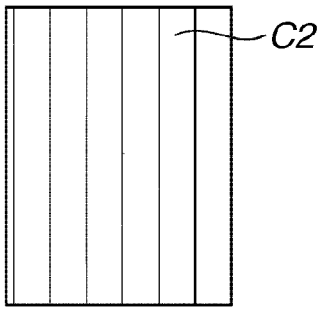
Figure 15D:
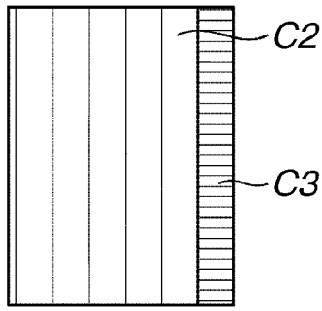

After storing the data of 16 columns in bank 1 of SRAM (2) 108 is completed, the data of the next 16 columns are again stored in bank 0. That is, the data of 13 columns read out from an area E in FIG. 14C are stored in an area E2 of bank 0 in SRAM (2) 108 as shown in FIG. 15E.

As described above, the storing of data into SRAM (2) 108 is performed alternately to bank 0 and bank 1.

<Reading Out Process from SRAM (2)>

The data stored in bank 0 of SRAM (2) 108 are transferred to the recording head 1 by one column. First, the data of addresses a to a+7 are read out and transferred. Next, the data of addresses b to b+7 are read out and transferred. Hereinafter, data of one column are similarly read out and transferred to the recording head. The reading out process of bank 0 in SRAM (2) 108 is completed after reading out from addresses p to p+7 and transferring the data.

After the reading of bank 0 in SRAM (2) 108 is completed, the data read out from SRAM (1) 106 are stored in bank 0 of SRAM (2) 108.

In addition, after the reading of bank 0 in SRAM (2) 108 is completed, the reading of bank 1 in SRAM (2) 108 is conducted.

As described above, according to the present embodiment, even in the case where a tilt of the recording head or a nozzle array exists, the time required for the data processing can be suppressed by reading and writing data independently in accordance with each block.

Other Embodiments

<Modified Example of the Column Position Pointer>

In the above embodiment, the pointer performs control over two banks. However, other configurations can be taken.

For example, a pointer for bank 0 of SRAM (1) 106 and a reading pointer for bank 1 can be provided independently as pointers of each block. That is, eight pointers can be provided to one bank, or 16 pointers to two banks.

The storing in bank 0 of SRAM (2) 108 is described as an example.

Here, for example, a pointer 00 is provided to block 0, a pointer 01 to block 1, and a pointer 07 to block 7. Ditto for the pointers of bank 1. A pointer 10 is provided to block 0 of bank 1 and a pointer 11 to block 1.

Here, block 0 will be described. Since the control of the other blocks is performed in the same way, their description will be omitted. The case will be described where a correction value of block 0 is 3.

As shown in FIG. 11, the pointer 00 indicates a column position d. The data of block d are read out from address d in accordance with the pointer 00. At this time, the pointer 10 of bank 1 is in a disabled state.

After reading out data of one column, the pointer 00 is moved forward to a column position e and conducts reading. In this way, control is performed so that the pointer is moved forward by one column position after a reading out process is conducted, which is the same as shown in the above-described embodiment.

The difference is that after the pointer reads out at a column position p, the reading of the next block 0 is conducted according to a pointer 10 of bank 1. The pointer 00 then becomes disabled and the pointer 10 becomes enabled. At this time, the reading control unit controls the pointer 10 to designate a column position a. Every time the pointer 10 conducts reading, the column position is moved forward.

After reading out from the column position p, the pointer 10 becomes disabled. Next, the pointer 00 becomes enabled and conducts reading from the column position a.

It should be noted that the size of one bank in SRAM (1) 106 and in SRAM (2) 108 is not limited to 16 columns but can take other values. For example, the column number can be 32 or 64.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2005-287389 filed Sep. 30, 2005, which is hereby incorporated by reference herein in its entirety.

What is claimed is:

1. A recording apparatus which records on a recording medium using a recording head having a plurality of recording element arrays in a main scanning direction, each of the recording element arrays including a plurality of recording elements in a direction of a tilt relative to a conveying direction of the recording medium in a plurality of blocks, the recording apparatus comprising:

an input unit configured to receive recording data;

an obtaining unit configured to obtain tilt correction information associated with each block;

a generating unit configured to generate a permission signal permitting drive of a plurality of recording elements for each block based on the correction information;

a first memory unit having a buffer that can store the recording data received by the input unit, the first memory unit capable of storing a recording data amount of at least one scanning of the recording head;

a second memory unit having a plurality of buffers that store data of m columns read from the first memory unit;

a third memory unit having a plurality of buffers that store data of m columns read from the second memory unit;

a first storage unit configured to read the data in m-column unit from the first memory unit by one-time DMA transfer and store the data in one of the buffers of the second memory unit;

a reading unit configured to read one column of data from the second memory unit in each block, based on a pointer corresponding to each block and the correction information;

a second storage unit configured to store the data of one column read by the reading unit in the same column position of the third memory unit;

a control unit configured to repeatedly execute the reading of the column of data by the reading unit and the storing of the data in the third memory unit by the second storage unit by m columns, while updating each column position read by the reading unit and the column position for storing by the second storage unit;

a transfer unit configured to read the data of one column from the third memory unit and transfer the data to the recording head; and a driving unit configured to drive the recording element in a unit of block, based on the permission signal generated by the generating unit.

2. The recording apparatus according to claim 1, wherein the control unit moves the pointer to a head column position of one of a plurality of banks after moving the pointer to a final column position of another of the plurality of banks.

3. The recording apparatus according to claim 1, wherein the reading unit has a mode of reading the data of one column from one of a plurality of banks, and a mode of reading out the data of a total of one column from a plurality of banks.

4. The recording apparatus according to claim 1, wherein the first storage unit performs the DMA transfer according to a predetermined timing signal.

5. The recording apparatus according to claim 1, further comprising a determination unit configured to determine the timing of performing the DMA transfer.

6. The recording apparatus according to claim 1, wherein the transfer process of the data of one column by the transfer unit, the reading process by the reading unit, and the storing process by the second storage unit are performed according to a predetermined timing signal.

7. The recording apparatus according to claim 1, wherein the first memory unit is a synchronous dynamic random access memory (SDRAM), and the second memory unit and the third memory unit are static random access memory (SRAM).

8. A method for controlling a recording apparatus which records on a recording medium using a recording head having a plurality of recording element arrays in a main scanning direction, the recording element arrays including a plurality of recording elements in a direction of a tilt relative to a conveying direction of the recording medium configured in a plurality of blocks, the recording apparatus including a first memory unit having a plurality of buffers that can store recording data of m columns, a second memory unit having a plurality of buffers that store data of m columns read from the first storage unit, and a third memory unit having a plurality of buffers that store data of m columns read from the second memory unit, the method comprising:

receiving recording data;

obtaining tilt correction information associated with each block;

generating a permission signal permitting drive of a plurality of recording elements for each block based on the tilt correction information;

reading the data in m-column unit from the first memory unit by one-time DMA transfer and storing the data in one of the buffers of the second memory unit;

reading one column of data from the second memory unit in each block, based on the pointer corresponding to each block and the correction information;

storing one column of the data read from the second memory unit in the same column position of the third memory unit;

reading the data of one column from the third memory unit and transferring the data to the recording head; and, driving the recording element in a unit of block, based on the permission signal generated.

9. The method according to claim 8, further comprising:

updating a column position for reading the data from the second memory unit and updating a column position for storing the data in the third memory unit; and repeating the reading of the data from the second memory unit and the storing of the data in the third memory unit.

* * * * *